US005205218A

United States Patent [19]

Theurer

[11] Patent Number: 5,205,218

[45] Date of Patent: Apr. 27, 1993

[54] TAMPING MACHINE AND METHOD FOR CONSOLIDATING THE BALLAST OF A TRACK

[75] Inventor: Josef Theurer, Wien, Austria

[73] Assignee: Franz Plasser Bahnbaumaschinen-Industriegesellschaft m.b.H, Vienna, Austria

[21] Appl. No.: 895,909

[22] Filed: Jun. 9, 1992

[30] Foreign Application Priority Data

Jun. 12, 1991 [AT] Austria ..... 1178/91
Feb. 4, 1992 [AT] Austria ..... 184/92

[51] Int. Cl.[5] ..... E01B 27/00
[52] U.S. Cl. ..... 104/12
[58] Field of Search ..... 104/2, 10, 12, 7.3

[56] References Cited

U.S. PATENT DOCUMENTS 2,482,796 9/1970 Philbrick ..... 104/12
3,651,762 3/1972 Plasser et al. ..... 104/12
3,682,101 8/1972 Plasser et al. ..... 104/12
3,910,195 10/1975 Theurer ..... 104/12
3,942,448 3/1976 Unbehaun et al. ..... 104/12
4,043,271 8/1977 Theurer ..... 104/12
4,090,451 5/1978 Theurer ..... 104/12
4,257,331 3/1981 Theurer et al. ..... 104/2

FOREIGN PATENT DOCUMENTS 2602161 9/1976 Fed. Rep. of Germany .
2516166 10/1976 Fed. Rep. of Germany .

*Primary Examiner*—Mark T. Le
*Attorney, Agent, or Firm*—Marmorek, Guttman & Rubenstein

[57] ABSTRACT

A method for continuously consolidating ballast under a track comprising rails and sleepers which are arranged transversely to the rails by a machine having tamping picks, comprises causing the tamping picks to pick up the ballast in front of the sleeper ends and push the ballast under the sleeper ends by a cycle of shovel movements comprising a consolidating movement in a direction which is parallel to the sleepers, an upward movement occurring immediately in front of the sleeper end faces, and a return movement counter to the consolidating movement, and continuously causing the tamping picks to repeat the cycle of shovel movements. Desirably, a continuous forward movement is superimposed on the cycle of shovel movements.

23 Claims, 4 Drawing Sheets

TAMPING MACHINE AND METHOD FOR CONSOLIDATING THE BALLAST OF A TRACK

BACKGROUND OF THE INVENTION

The invention relates to a method for consolidating ballast, wherein the track is lifted into a desired position and the ballast is consolidated in this region parallel thereto by setting tamping picks into positioning motion extending perpendicularly to the longitudinal direction of the machine, followed by a vertical and forward movement of the tamping pick, and relates also to a tamping machine for implementing this method.

A machine arrangement known from U.S. Pat. No. 4,257,331 is composed of a cleaning machine, arranged in front in the working direction, for cleaning the bedding ballast, and a trailer coupled therewith. The cleaning machine has a machine frame supported on rail bogies, a clearing device for picking up and a screening unit for cleaning the uncleaned ballast and a conveyor belt device for discharging the cleaned ballast. A consolidating device, mounted so as to be displaceable in the longitudinal direction of the machine and vertically adjustable and comprising consolidating tools designed as a pressure thrust tool, is provided between rail bogies disposed at the ends of the trailer. Further, a track lifting unit is connected to a reference system and a sweeping device is connected to the trailer. With a machine arrangement of this kind the track can be moved into a better position immediately following the cleaning of the ballast bed and the ballast can be preconsolidated at the same time. With consolidating tools of this kind, however, the ballast is consolidated specifically in the region of the spaces between the sleepers and not underneath the sleepers.

A tamping machine is already known from U.S. Pat. No. 3,910,195, comprising a vertically adjustable tamping unit having tamping picks which may be positioned and vibrated by drives. In addition to the tamping picks whose position may be adjusted in the longitudinal direction of the machine, further tamping picks are provided on each longitudinal side of the machine in the region in front of the sleeper ends, each designed to be capable of swivellng about an axis extending in the longitudinal direction of the machine. These two side tamping picks are spaced apart from one another such that when two adjacent sleepers are tamped by the tamping unit, the side tamping picks come to rest precisely in the sleeper end region of the sleepers to be tamped. This enables the ballast underneath the sleepers to be tamped on the longitudinal sides and end faces of the sleepers at the same time. However, before each tamping operation the tamping unit has to be centered precisely over the sleepers to be tamped, lowered, raised and them moved forward to the next sleepers to be tamped. There the whole machine has to be brought to a standstill in order to center the tamping unit and the tamping unit has to be lowered.

The object of the present invention lies in providing a method of consolidating the ballast which enables ballast consolidation to be performed quickly and simply and with increased output, particularly in the case of a completely unconsolidated ballast bed after the cleaning thereof.

SUMMARY OF THE INVENTION

This object is achieved according to the invention in that the ballast is picked up in the region in front of the sleeper ends, pushed under the sleeper ends and consolidated exclusively by means of an endless, continuously repeating shovel movement of the tamping picks, composed of a consolidating movement extending in the longitudinal direction of the sleepers, an upward movement occurring immediately in front of the end faces of the sleepers and a subsequent return movement of the tamping picks counter to the consolidating movement. Particularly in the case of a completely unconsolidated ballast bed, this kind of ballast consolidation enables very efficient tamping to be performed with a relatively high kilometer output, as centering the tamping picks relative to the sleepers to be tamped, which is time-consuming, is no longer necessary. Since the tamping picks are arranged outside the sleepers in the region in front of the ends thereof, there is potentially, if wished, a relatively long positioning path totally without obstruction. As a result of the endless, rapidly repeating shovel movements with a relatively long positioning path in the longitudinal direction of the sleepers, fairly large quantities of ballast can also be quickly moved without difficulty into the region beneath the sleeper ends. This new tamping method is therefore particularly suitable for the preconsolidation — to be performed in the course of a continuous forward working movement — of a ballast bed which is completely unconsolidated after cleaning, this preconsolidating process resulting in a more stable track position for high speed travel.

A further increase in output can be achieved with the further advantageous step of superimposing a continuous forward movement on the shovel movement of the picks so that the ballast is also consolidated in the spaces between the sleepers in the course of a continuous forward working movement — by insertion of the tamping picks into the region in front of the sleeper ends which lies between the sleepers.

The invention also relates to a tamping machine for implementing the method, all the tamping picks for a continuous forward working movement being exclusively arranged on both longitudinal sides of the machine in the region in front of the sleeper ends. A tamping unit designed in this way is structurally particularly simple to manufacture and, without further constructional expense, enables the tamping machine to perform an efficient continuous forward working movement. This is made possible by the fact that the working region of the tamping picks is located solely in the region in front of the sleeper ends which is "obstruction-free" — with respect to the movement of the tamping picks in the longitudinal direction of the machine — so that the tamping picks can be freely inserted into the ballast — totally independently of the sleeper position — at all times and without a time-consuming centering process. A further advantage of a tamping machine of this kind also lies in the fact that — in comparison with the conventional tamping units which have tamping picks located between the sleepers — the positioning or consolidation path of the tamping picks may be extended if desired in order to move larger quantities of ballast. Viewed overall, a tamping machine of this kind is suitable quite specifically for the very efficient preconsolidation of a ballast bed immediately after the cleaning thereof.

A further development of the invention in which the tamping picks are mounted on a transversely displaceable tool carrier enables the tool carrier advantageously to be centered relative to the track axis in track curves, so that the constant consolidation of ballast can also be achieved irrespective of the track curvature.

A further development in which the tamping picks are connected to the tool carrier by a parallelogram hinge permits a cyclical tamping movement with a lifting movement following the tamping movement — directed towards the center of the track — and with a return movement into a starting position. This reliably ensures that ballast is always only moved towards the center of the track.

A further development in which a lower parallel guide rod of the parallelogram hinge is designed as a hydraulic positioning drive enables the distance between the tamping picks and tool carrier or end faces of the sleeper to be changed quickly without affecting the vertical adjustability.

A development in which an electrical displacement pick-up is connected to hinge points of the parallelogram hinge has the advantage that the displacement pick-up enables the positioning movement and vertical adjustment of the tamping picks to be precisely controlled for an automatic cycle without the end faces of the sleepers being touched by the tamping picks.

A further development in which a vertical adjustment drive is connected to an upper parallel guide rod of the parallelogram hinge enables the tamping picks to be vertically adjusted without obstruction, parallel to the positioning movement of the tamping picks.

In order to eliminate thrust forces which act on the tamping picks as a result of the ballast, it is an advantage, in a further advantageous development, if in addition to the transverse guide the side tamping units are mounted so as to be displaceable in the longitudinal direction of the machine. This enables the tamping picks to be held stationary for a short time in order to perform the positioning movement relative to the track, while the machine arrangement can be moved continuously and unrestrictedly.

A further development in which a track lifting unit is connected to lifting and aligning drives enables the track lifting unit to be freely deflected relative to a trailer frame even in sharp curves in the track.

A further development in which an actuable cam is connected to the track lifting unit advantageously makes it possible for any high points of the track, formed by the uneven discharge of ballast in the region of the cleaning machine, to be lowered into the ideal position and for the ballast consolidation as a whole also to be intensified.

A further development in which a measuring vehicle is provided advantageously enables a trailer frame to be used as a reference plane for levelling the track.

With a further development in which control equipment connected to a front inclination measuring device is provided, it is possible to achieve the advantage that the transverse inclination of the actual track position can be transmitted, path-displaced, to the lifting device of the track lifting unit by means of the front inclination measuring device.

A machine combination in which the inventive tamping machine is combined with a ballast bed cleaning machine has the particular advantage that on the one hand the structural expense is very low because of the design as a trailer and on the other hand the preconsolidation of the cleaned ballast can be performed immediately following the returning of the cleaned ballast, in order to stabilize the track position. Altogether, by using a machine combination of this kind it is possible to obtain, without additional expenditure on personnel and immediately after starting work, a relatively precise track position — in relation to solutions known hitherto — with a preconsolidated ballast bed, with the result that the track is already passable at high speed before the actual tamping operations. This is particularly advantageous when, as a result of very short track stoppages, conventional tamping of a track can no longer be performed immediately following the cleaning machine.

A further development of the tamping machine in which vertically adjustable stabilizing units are provided, also enables the track to be lowered in a controlled manner immediately following ballast consolidation by means of the stabilizing units, so as to achieve further ballast consolidation in anticipation of settling of the track caused by railway traffic.

A particularly efficient working application is made possible by the design of the tamping machine wherein the tamping units and the track lifting units are secured to a unit frame and wherein the machine travels forward continuously while the tamping picks, at the moment of ballast consolidation, are stationary locally with respect to the track in relation to the longitudinal movement. The consolidation operation is thereby made easier, particularly with fairly major errors in the track position, and the tamping result is thereby improved.

Finally, with the further development of providing the tamping machine with a stabilizing unit, a sweeping device, and a ballast plow, there is the advantageous facility for tamping, stabilizing and ballasting the track in a single, efficient operation. Since insertion of the tamping picks into the individual spaces between the sleepers is no longer necessary because of the special design of the tamping units, the use of the tamping machine is particularly suitable in sections of the track which have very irregular sleeper spacings.

BRIEF DESCRIPTION OF THE DRAWINGS

The invention is described in more detail below with reference to embodiments represented in the drawings, in which.

DETAILED DESCRIPTION OF THE INVENTION

Figure 1:
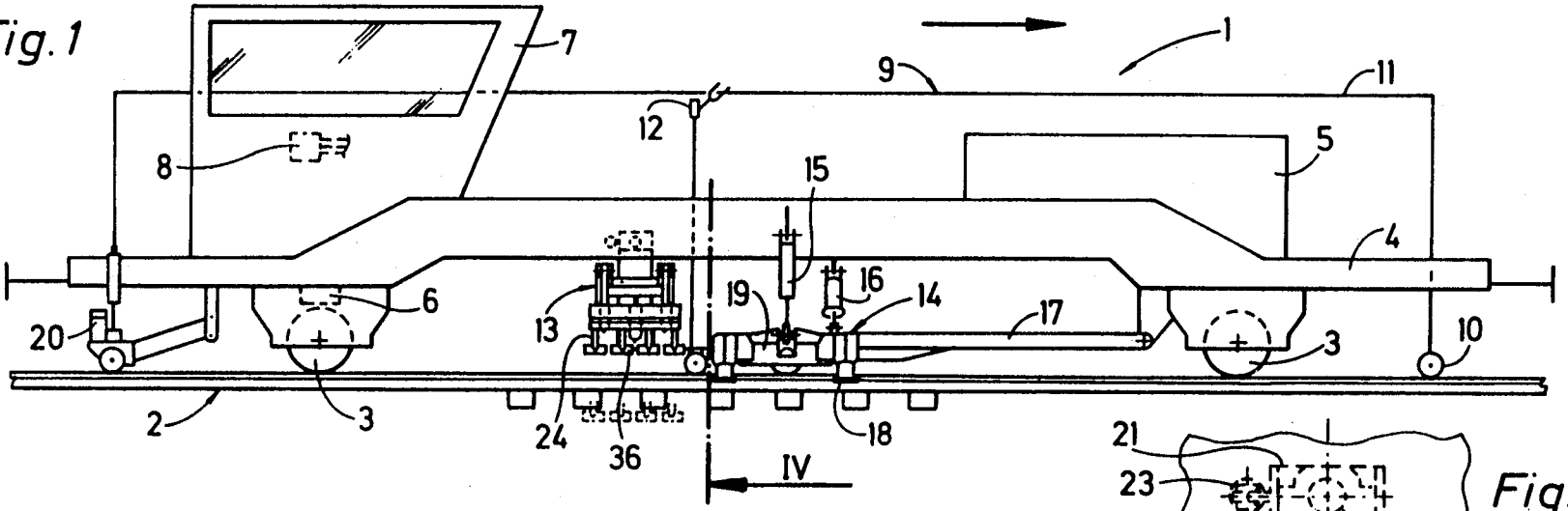
FIG. 1 shows a side view of a tamping machine designed according to the invention with tamping units arranged between rail bogies on a machine frame.
Figure 2:
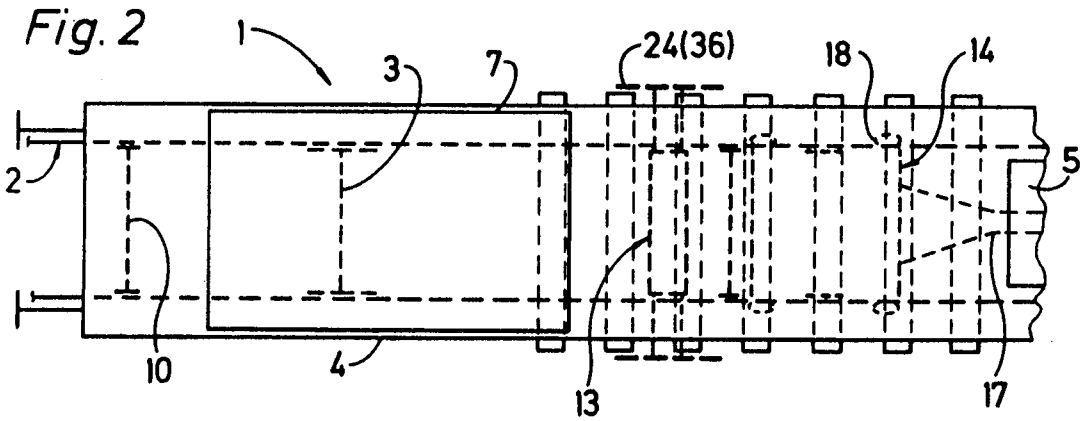
FIG. 2 shows a schematic partial plan view of the tamping machine.

The tamping machine 1 evident in FIG. 1 for consolidating a ballast bed of a track 2 comprises a machine frame 4 supported on rail bogies 3, a motor 5 with a motive drive 6 and a driver's cabin 7 with central control equipment 8. A levelling and alignment reference system 9 connected to the tamping machine is essentially composed of three measuring vehicles 10, spaced apart from one another in the longitudinal direction of the machine and connected to the machine frame 4 so as to be vertically adjustable, stretched chords 11 and a vertical displacement pickup 12.

The tamping machine 1 is connected between the two rail bogies 3, disposed at the ends, to a vertically adjustable tamping unit 13 and a track lifting and aligning unit 14 arranged immediately in front in the working direction. The track lifting unit 14 which has lifting and alignment drives 15, 16 is flexibly connected to the machine frame 4 in the region of the front rail bogie 3 by a connecting rod 17 extending in the longitudinal direction of the machine. Moreover, the track lifting unit 14, which may be rolled along the track 2 by means of flanged rollers and which has lifting rollers 18 which can be respectively positioned against the outside of the rail, is further equipped with a cam 19, capable of being acted upon by a drive, to generate horizontal vibrations extending perpendicularly to the longitudinal direction of the machine. A transverse inclination measuring device 20 is connected to the rear measuring vehicle 10.

Figure 4:
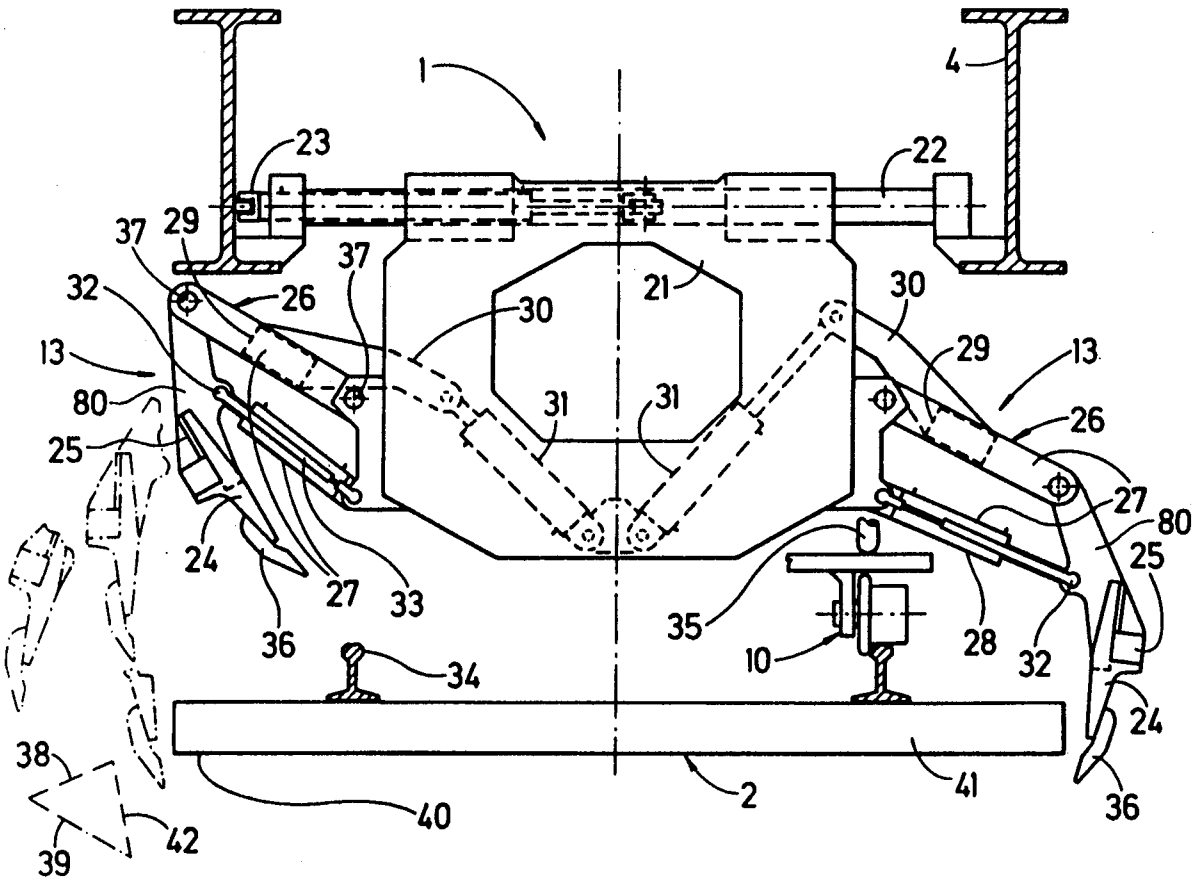
FIG. 4 shows an enlarged cross-section through the tamping machine along the section line IV in FIG. 1, FIGS. 5 and 6 show enlarged views of a further embodiment of a tamping unit in the longitudinal direction of the machine.

As is evident in FIG. 4, two tamping units 13, lying opposite one another in the transverse direction of the machine, are mounted on a tool carrier 21 which is itself mounted so as to be displaceable on a transverse guide 22 extending horizontally and perpendicularly to the longitudinal direction of the machine, and is connected to a transverse displacement drive 23. Tamping picks 24 disposed in the region in front of the sleeper ends are in each case secured to a connecting carrier 25 extending in the longitudinal direction of the machine. The connecting carrier 25 is actually a long bracket to which all four tamping picks are attached. Each carrier 25 comprises two supports 80 which are arranged parallel to one another and which are connected to the tool carrier 21 by two parallel guide rods 27 arranged one above the other (FIG. 4). Each set of two guide rods 27, together with the associated support 80, forms a parallelogram hinge 26 extending perpendicularly to the longitudinal direction of the machine. The lower one of each pair of guide rods 27 is in the form of a hydraulic positioning drive 28, i.e., the length of each lower guide rod 27 is variable. The two upper parallel guide rods 27 of a tamping unit 13 are connected to one another by a carrier or beam 29 extending in the longitudinal direction of the machine, which carrier or beam 29 is itself connected on two parallel levers 30 the other ends of which are hinged to a vertical adjustment drive 31.

A displacement pick-up 33 which may be telescopically displaced longitudinally and which is designed as an inductive pick-up is connected to hinge points 32 of the positioning drive 28. The displacement pick-up 33 does not act directly on the drives 28 and 31 but is connected to the control equipment 8 which in turn controls the action of drives 28 and 31 according to the signals received from the pick-ups. Provided between the tamping unit 13 and the track lifting and aligning unit 14 (see FIG. 1) is a measuring vehicle 10 having flanged rollers and an expanding drive for lateral pressure against a rail 34 of the track 2. Supported on this measuring vehicle 10 is a reference rod 35, mounted so as to be vertically adjustable, which is connected to the vertical displacement pick-up 12 secured to the machine frame 4. Vertical adjustment drive 31 only serves to raise and lower tamping picks 24; therefore there is no need for a separate displacement pick-up for this drive. Its action is controlled in dependence on position signals produced by the displacement pick-up 33. The shovelling movement of the tamping picks is caused by the action of positioning drive 28 being superimposed on the lowering and raising movement. By means of the displacement pick-up 33, it is possible for the control equipment to "know" the position of the tamping picks and to control both drives 28 and 31 accordingly to make the tamping picks move as indicated by the dashed lines 38, 39 and 42.

Figure 3:
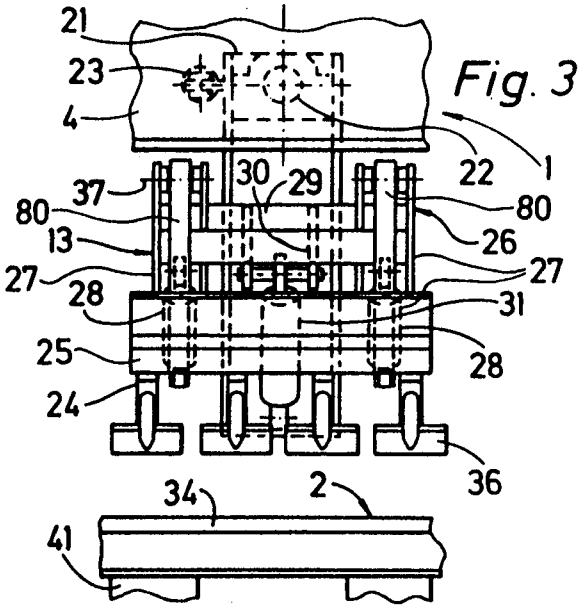
FIG. 3 shows an enlarged side view of the tamping unit with the tamping picks.

As is evident particularly in FIG. 3, each tamping unit 13 has four tamping picks 24 arranged one immediately behind the other in the longitudinal direction of the machine and each connected to a pick plate 36 The vertical adjustment drive 31 is arranged centrally between the two positioning drives 28.

In operational use the tamping machine 1 moves forwards continuously at a uniform speed along the track 2 — in the working direction represented by an arrow in FIG. 1. In order to consolidate the ballast, the tamping picks 24 are lowered, with action upon the two vertical adjustment drives 31, and at the same time, with action upon the positioning drives 28, are expanded outwards (see the dot and dash displacement line 38 in FIG. 4) about the axes 37 extending in the longitudinal direction of the machine. The tamping picks 24 are then further lowered by further action upon the vertical displacement drives 31, a positioning or consolidating movement of at least about 150 mm by the tamping picks 24 (see movement line 39) directed towards the center of the machine occurring at the same time with action by the positioning drives 28. The cleaned and unconsolidated ballast lying in the region in front of the sleeper ends is thereby pressed under the sleeper end region 40 of sleepers 41 and consolidated. As soon as this positioning movement has achieved a certain displacement optionally determined in the displacement pick-up 33, and the pick plates 36 lie immediately in front of the sleeper end region 40, the action upon the positioning drives 28 is automatically stopped and lifting occurs immediately afterwards by means of the vertical adjustment drives 31 (see movement line 42). Then, as already mentioned, a 15 combined lowering and expanding movement of the tamping picks 24 into the extreme starting position represented in FIG. 4 by dot and dash lines occurs automatically. This approximately triangular endless shovel movement for consolidating the ballast beneath the sleeper end region 40 is automatically performed continuously and independently of the superimposed forward movement. So that the ballast is also evenly consolidated in track curves with curved track sections, the tool carrier 21 along with the two tamping units 13 is moved transversely in these sections of the transverse displacement drive 23 until the tool carrier 21 comes to rest centrally in relation to the sleepers 41 lying beneath it. Levelling and lateral alignment of the track 2 is performed in parallel with this continuously ballast consolidating operation by means of the track lifting and aligning unit 14 and the levelling and alignment reference system 9.

Figure 5:
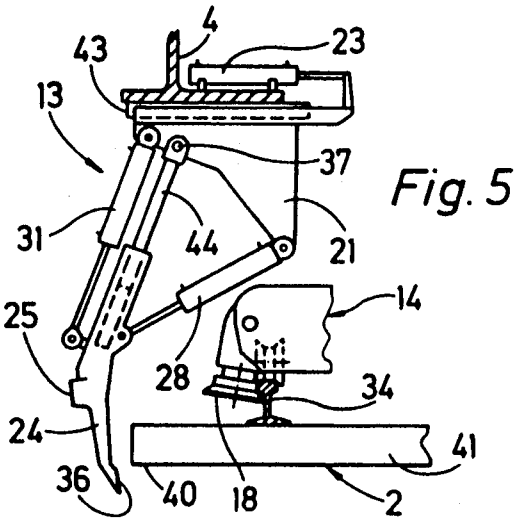
Figure 6:
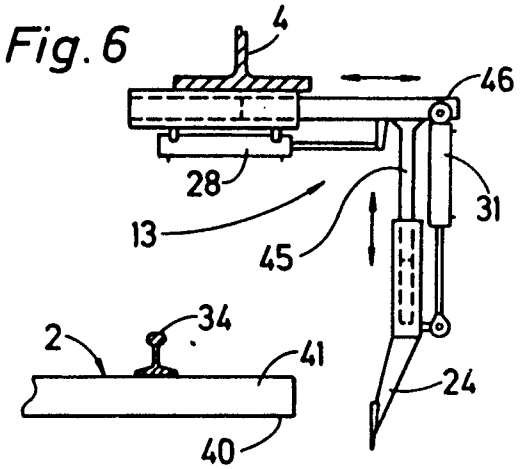

In the tamping units 13 represented in part in FIGS. 5 and 6, identical components are provided with the same reference numerals as in FIGS. 1 to 4 for the sake of simplicity. In the tamping unit 13 represented in FIG. 5, the tool carrier 21 is divided into two parts and is connected to tamping picks 24 arranged on respective longitudinal sides of the machine. Each of the two tool carriers 21 is mounted so as to be transversely displaceable by means of its own transverse displacement drive 23 along a transverse guide 43 connected to the machine frame 4 and extending perpendicularly to the longitudinal direction of the machine. The tamping picks 24 arranged on one longitudinal side of the machine and connected to one another by the connecting carrier 25 are in each case mounted so as to be displaceable in the longitudinal direction of a guide rod 44 mounted on the tool carrier 21 so as to be pivotable about an axis 37 extending in the longitudinal direction of the machine. The shovel-like tamping movement of the tamping picks 24 is performed in the manner already described above by successive or combined action upon the drives 28 and 31.

The tamping picks 24 of the tamping unit 13 represented in FIG. 6 which are likewise arranged on the longitudinal side of the machine are mounted so as to be vertically adjustable along a vertical guide rod 45 by means of the vertical adjustment drive 31. This guide rod is connected, together with the vertical adjustment drive 31, to a horizontal transverse guide 46 mounted on the machine frame 4 so as to be transversely displaceable by means of the positioning drive 28.

Figure 7:
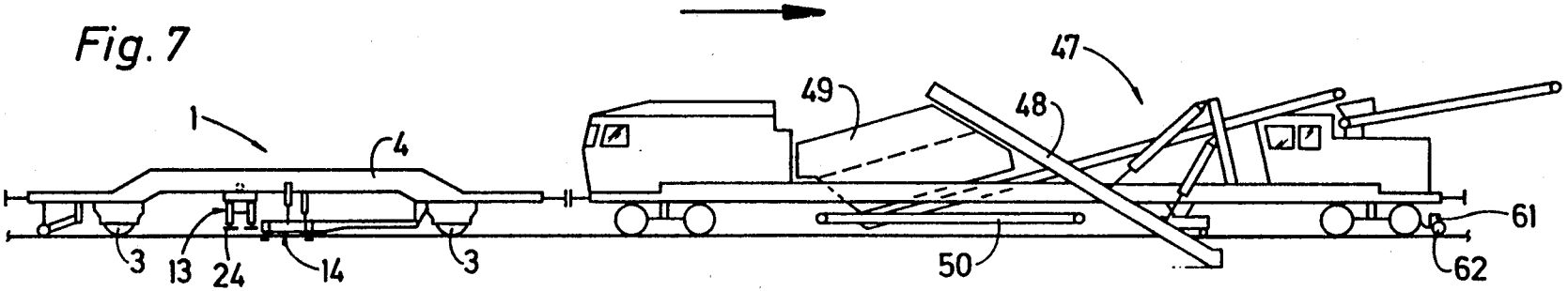
FIGS. 7 and 8 show schematic side views of a combination of a tamping machine designed as a trailer with a further track laying machine.

A tamping machine 1 evident in FIG. 7 is designed as a trailer which is coupled to a ballast bed cleaning machine 47 comprising a vertically adjustable clearing chain 48, a screening unit 49 and a conveyor belt arrangement 50 for the introduction of the cleaned ballast. Unlike the tamping units 13 described in FIGS. 1 to 4, these tamping units respectively have only two tamping picks 24 arranged on a longitudinal side of the machine one behind the other in the longitudinal direction of the machine. The machine frame 4, connected neither to the driver's cabin nor to a motive drive, serves at the same time as a reference basis for levelling the track. With a machine combination of this kind, the cleaned ballast can be consolidated immediately after its introduction by means of the two tamping units 13 in a continuous forward working movement connected to the cleaning machine. Provided at the front end of the cleaning machine is an inclination measuring device 61, movable along the track by a measuring vehicle, and a displacement measuring device 62.

Figure 8:
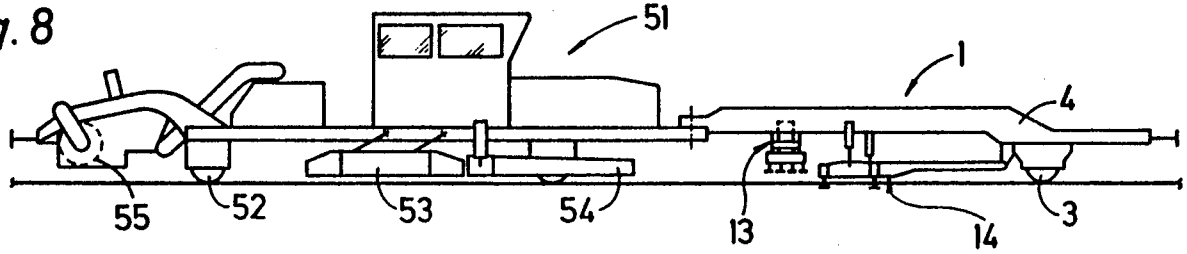

A tamping machine 1 represented in FIG. 8 is designed as a trailer, the rear end of which is flexibly secured to a ballast plow 51. Between its rail bogies 52 the ballast plow 51 itself has a center and side plow 53 and 54 respectively and a vertically adjustable sweeping device 55. With a machine combination of this kind, prescribed ballasting of the track can be performed immediately following the consolidating of the ballast.

Figure 9:
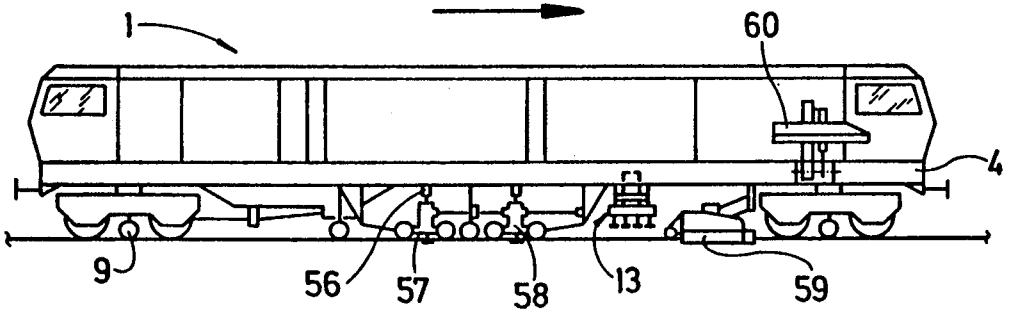
FIG. 9 shows a side view of a tamping machine with stabilizing units.

Finally, in addition to the tamping units 13 arranged on each longitudinal side of the machine, a tamping machine 1 represented in FIG. 9 has stabilizing units 57 connected to the machine frame 4 and vertically adjustable by means of drives 56. These stabilizing units are in each case equipped with a driveable cam 58 for generating vibrations extending horizontally and transversely to the longitudinal direction of the machine. A center plow 59 and side plows 60 are further arranged in front of the tamping unit 13.

For the tamping application, the stabilizing units 57 may be used as a track lifting and aligning unit by action upon the drives 56 and in cooperation with the levelling and alignment reference system 9, in order to perform correction of the track position. In a subsequent second work cycle, the previously corrected track is lowered in a controlled manner by using the stabilizing units 57, with appropriate ballast consolidation. It is also possible, however, to stabilize the track by means of the stabilizing units 57 and to consolidate the ballast using the tamping units 13 in a joint work cycle. In parallel with this, it is possible to ballast the track as required by means of the center and side plows 59, 60 disposed in front.

Figure 10:
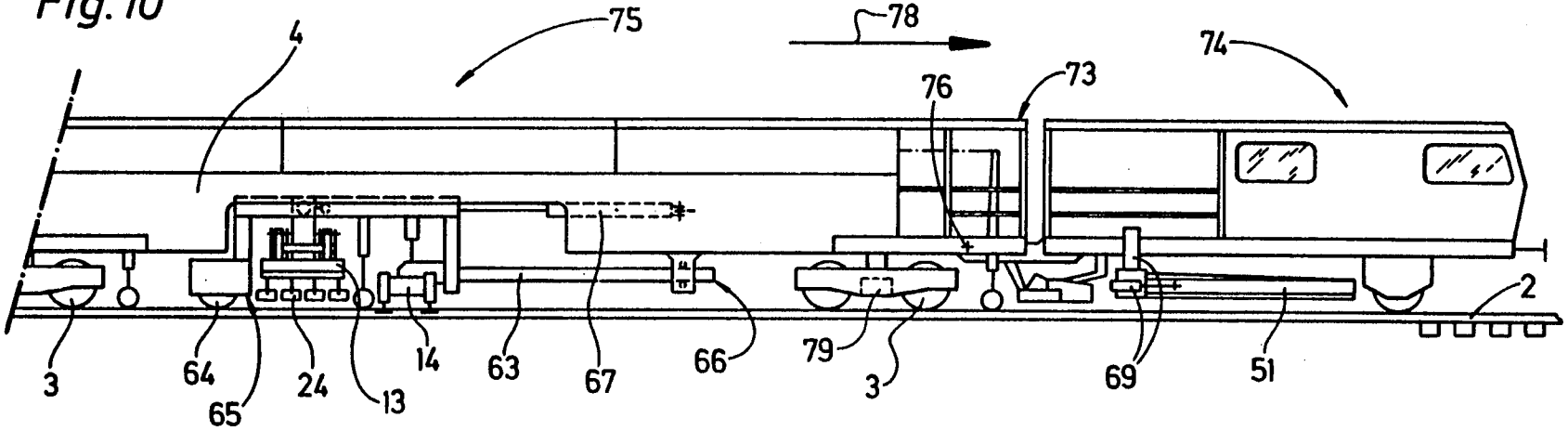
FIGS. 10 and 11 show side views of a further embodiment of a tamping machine, in which the tamping unit is secured to a unit frame which is displaceable relative to the machine frame.
Figure 11:
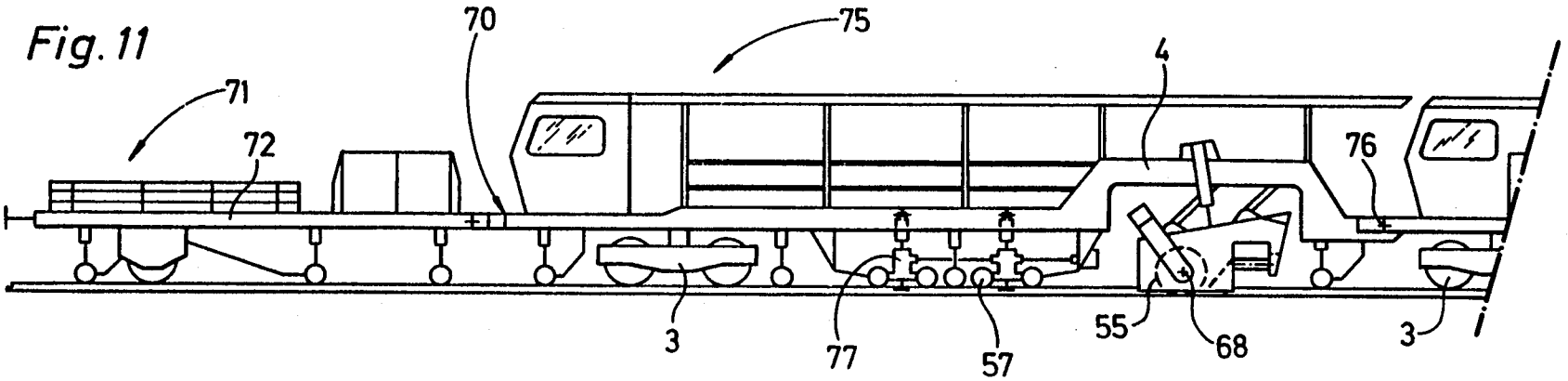

Another tamping machine 75 represented in FIGS. 10 and 11 has at its rear end 70 a trailer 72, designed as a material and fuel vehicle 71, which is flexibly connected to the machine frame 4 supported on rail bogies 3. The machine frame is composed of three frame sections flexibly connected to one another in the region of an articulation point 76 and has two stabilizing units 57, disposed one behind the other in the longitudinal direction of the machine and each having a vibration drive 77, and a sweeping device 55. The latter is rotatable by means of a drive about an axis 68 extending transversely to the longitudinal direction of the machine. The second frame section, in the working direction (see arrow 78), of the machine frame 4 is connected to a unit frame 63 to which a tamping unit 13 and a track lifting and aligning unit 14 are secured. The unit frame 63 is supported at its rear longitudinal end 65 by way of a rail bogie 64 and at its front longitudinal end 66 directly on the machine frame 4 so as to be displaceable in the longitudinal direction of the machine, and is provided with a longitudinal displacement drive 67. Disposed in the front of the tamping unit 13, in the working direction, are ballast plows 51 which are vertically adjustable by means of drives 69.

In operational use, the machine frame 4 is continuously moved on in the working direction represented by the arrow 78, while, in parallel therewith, the unit frame 63 is gradually moved forward from one tamping location to the next by means of the longitudinal displacement drive 67. After the unit frame 63 has been advanced to its most forward end position, it is held stationary in that location, the ballast beneath the sleeper end region being consolidated by lowering of the tamping picks 24 in the manner already described. The track 2 is lifted into the correct track position or provisional desired position by means of the track lifting and aligning unit 14 in conjunction with a levelling and reference system which is not represented specifically. After the desired consolidation of the ballast by means of the tamping unit 13, the unit frame 63, which has meanwhile been moved into the rear end position by the continuous forward movement of the machine frame 4, is again advanced. The track is again lowered in a controlled manner into a final desired position, with further consolidation of the ballast, by means of the following stabilizing units 57 in conjunction with a levelling and reference system which is not represented specifically. In parallel with the tamping of the track, the prescribed ballasting thereof is implemented by the ballast plow 51 and the sweeping device 55.

While the invention has been described by reference to specific embodiments, this was for purpose of illustration only. Numerous alternative embodiments will be apparent to those skilled in the art and are considered to be within the scope of the invention.

I claim:

1. A method for continuously consolidating ballast under a track, comprising rails and sleepers which are arranged transversely to said rails and have sleeper ends with sleeper end faces, by a machine having tamping picks, comprising raising said track to a desired position, causing said tamping picks to push said ballast in front of and under said sleeper ends by a cycle of shovel movements comprising a consolidating movement in a direction which is perpendicular to said rails, an upward movement occurring immediately in front of said sleeper end faces, and a return movement counter to said consolidating movement, and continuously causing said tamping picks to repeat said cycle of shovel movements.

2. A method according to claim 1 further comprising superimposing a forward movement in a longitudinal direction of said machine on said cycle of shovel movements.

3. A method according to claim 1 wherein said consolidating movement amounts to a movement by at least about 150 mm.

4. A method according to claim 1 wherein in order to effect said cycle of shovel movements, said tamping picks are moved in said consolidating movement up to a point immediately in front of said sleeper end faces, said tamping picks are then raised, and immediately afterwards in a combined movement are lowered and moved outwards counter to said consolidating movement, while a steady forward motion in a longitudinal direction of said machine is superimposed on these movements.

5. A method according to claim 4 wherein said consolidating movement comprises a movement by said tamping picks in a direction which is at an angle with the sleepers.

6. A tamping machine for continuously consolidating ballast under a track comprising rails and sleepers which are arranged transversely to rails and have sleeper ends with sleeper end faces, said machine comprising a machine frame supported on rail bogies, a tamping unit having tamping picks which are movable in directions perpendicular to a longitudinal direction of said machine by means of positioning drives, said positioning drives causing said tamping picks to push said ballast in front of and under said sleeper ends by a continuous cycle of shovel movements comprising a consolidating movement in a direction which is perpendicular to said rails an upward movement occurring immediately in front of said sleeper end faces, and a return movement counter to said consolidating movement, wherein said machine continuously moves forward in said longitudinal direction, and all of said tamping picks are arranged on longitudinal sides of said machine and in front of said sleeper ends.

7. The tamping machine of claim 6 further comprising first and second tamping units, a common tool carrier on which said first and second tamping units are mounted opposite each other in a direction which is transverse to said longitudinal direction, a transverse guide on which said common tool carrier is mounted, and a transverse displacement drive which adjusts the position of said common tool carrier on said transverse guide.

8. The tamping machine of claim 7 wherein each of said tamping units includes at least first and second tamping picks disposed one behind the other in said longitudinal direction, each of said tamping picks including a pick plate, and a parallelogram hinge connecting said tamping picks to said common tool carrier, said tamping picks being pivotable about an axis of said parallelogram hinge which is parallel to said longitudinal direction.

9. The tamping machine of claim 7 further comprising a connecting carrier extending in said longitudinal direction in which said tamping picks are secured, and a parallelogram hinge flexibly connecting said connecting carrier to said common tool carrier, said parallelogram hinge including upper and lower parallel guide rods extending perpendicularly to said longitudinal direction.

10. The tamping machine of claim 9 wherein said lower parallel guide rod comprises a hydraulic positioning drive for adjusting the horizontal position of said tamping picks.

11. The tamping machine of claim 10 further comprising an electrical displacement pick-up connected at hinge points of said hydraulic positioning drive for determining and controlling the horizontal displacement of said tamping picks.

12. The tamping machine of claim 11 wherein said electrical displacement pick-up comprises an inductive pick-up with two longitudinally displaceable telescopic rods each secured to one of said hinge points.

13. The tamping machine of claim 12 wherein said positioning drives further include a vertical adjustment drive hingedly connected to said common tool carrier and to said upper parallel guide rod.

14. The tamping machine of claim 13 wherein said displacement pick-up is associated with said hydraulic positioning drive and said vertical adjustment drive to effect said continuous cycle of shovel movements.

15. The tamping machine of claim 13 wherein said common tool carrier is connected to said tamping units, to said hydraulic positioning drive and said vertical adjustment drive, wherein said common tool carrier and said transverse guide are mounted on said machine frame, and wherein said tamping machine frame further comprises a longitudinal displacement drive for displacing said tool carrier in said longitudinal direction.

16. The tamping machine of claim 6 further comprising a trailer mounted on front and rear rail bogies, and lifting and aligning drives, and wherein said track lifting unit is arranged immediately in front of said tamping unit in a working direction, is connected to said lifting and aligning drives and disposed approximately centrally between said front and rear rail bogies, and is flexibly connected to said machine frame in the region of said front rail bogie by a longitudinal connecting rod.

17. The tamping machine of claim 16 further comprising a drive actuated cam connected to said lifting unit for generating horizontal vibrations in a direction perpendicular to said longitudinal direction.

18. The tamping machine of claim 6 further comprising a measuring vehicle having flanged rollers, and a vertically adjustable vertical reference rod connected to a vertical displacement pick-up, said measuring vehicle being located between said tamping and track lifting units.

19. The tamping machine of claim 6 further comprising a ballast bed cleaning device designed as a trailer, said tamping unit being arranged on said machine frame which is coupled to said ballast bed cleaning device.

20. The tamping machine of claim 6 further comprising a stabilizer means located in a region near said tamping unit, a vertically adjustable stabilizing drive connected to said stabilizer means, said stabilizer means equipped with a cam drive for generating horizontal vibrations.

21. The tamping machine of claim 6 further comprising a unit frame to which said tamping unit and said track lifting unit are secured, said unit frame being supported at one longitudinal end by a rail bogie and at a second longitudinal end by said machine frame, and a longitudinal displacement drive for displacing said unit frame longitudinally relative to said machine frame.

22. The tamping machine of claim 21 further comprising a stabilizing unit and a sweeping device which is rotatable about a horizontal axis extending transversely to said longitudinal direction, said stabilizing unit and sweeping device being disposed after said tamping unit in a working direction.

23. The tamping machine of claim 21 further comprising a vertically adjustable plow.

* * * * *